US005795032A

United States Patent [19]

Zimmerman

[11] Patent Number: 5,795,032

[45] Date of Patent: Aug. 18, 1998

[54] MINING MACHINE WITH MULTIPLE PROPULSION MEMBERS

[75] Inventor: Joseph J. Zimmerman, Franklin, Pa.

[73] Assignee: Joy MM Delaware, Inc., Wilmington, Del.

[21] Appl. No.: 664,685

[22] Filed: Jun. 17, 1996

[51] Int. Cl.[6] ..... E21B 29/22

[52] U.S. Cl. ..... 299/33; 299/64

[58] Field of Search ..... 299/31, 33, 64

[56] References Cited

U.S. PATENT DOCUMENTS

| | | | |
|---|---|---|---|
| 1,736,853 | 11/1929 | Fisher | 299/33 X |
| 2,642,984 | 6/1953 | Mercier | 198/301 |
| 2,674,364 | 4/1954 | Cartlidge | 198/303 |
| 2,722,409 | 11/1955 | Bergmann | 299/56 |
| 2,839,281 | 6/1958 | Alspaugh et al. | 299/30 |
| 2,872,170 | 2/1959 | Alspaugh et al. | 299/30 |
| 2,978,235 | 4/1961 | Felbeck et al. | 299/56 |
| 3,040,829 | 6/1962 | Terrell | 180/9.1 |
| 3,074,701 | 1/1963 | Moon | 299/57 |
| 3,107,776 | 10/1963 | Long | 198/303 |
| 3,135,502 | 6/1964 | Muehlman | 299/56 |
| 3,361,248 | 1/1968 | Daymon | 198/303 |
| 3,490,625 | 1/1970 | Ivy | 180/24 |
| 3,730,593 | 5/1973 | Karlovsky, Jr. | 299/76 |
| 3,747,718 | 7/1973 | Gauchet | 180/9.1 |
| 3,879,088 | 4/1975 | Sodder, Jr. et al. | 299/31 |
| 4,088,371 | 5/1978 | LeBegue et al. | 299/76 |
| 4,305,620 | 12/1981 | Hart | 299/7 |
| 4,362,337 | 12/1982 | Casanova | 299/33 X |
| 4,556,257 | 12/1985 | Justice et al. | 299/68 |
| 4,784,439 | 11/1988 | Wrulich et al. | 299/64 X |
| 4,909,341 | 3/1990 | Rippingale et al. | 180/9.1 |
| 5,033,605 | 7/1991 | Marguart | 198/300 |
| 5,102,199 | 4/1992 | LeBegue | 299/10 |
| 5,112,111 | 5/1992 | Addington et al. | 299/18 |
| 5,188,208 | 2/1993 | Hall | 198/312 |
| 5,232,269 | 8/1993 | Addington et al. | 299/67 |
| 5,246,274 | 9/1993 | Smith et al. | 299/18 |
| 5,261,729 | 11/1993 | Addington et al. | 299/64 |
| 5,364,171 | 11/1994 | Addington et al. | 299/18 |

FOREIGN PATENT DOCUMENTS

| | | |
|---|---|---|
| 2 427 461 | 12/1979 | France . |
| 763594 | 7/1978 | U.S.S.R. . |
| 777328 | 6/1957 | United Kingdom . |
| 96/12869 | 5/1996 | WIPO . |

*Primary Examiner*—David J. Bagnell
*Attorney, Agent, or Firm*—Kirkpatrick & Lockhart LLP

[57] ABSTRACT

A mining machine that has an elongated frame member and a mining assembly attached thereto for dislodging material from a seam upon contact therewith. The mining machine is equipped with at least one first propulsion member for propelling the mining machine on a surface. In addition, a second propulsion member is pivotally attached to the frame member and is selectively pivotable between a first retracted position adjacent the top portion of the frame member and a second extended position wherein the second propulsion member engages the roof of an entry formed by the mining machine to provide additional propulsion to the mining machine. The mining machine is also equipped with a conveying apparatus for conveying dislodged material from the front portion of the frame member to the rear portion thereof for discharge therefrom. In the alternative, the mining machine may be equipped with propulsion members that can selectively engage the side walls of the entry or the mining machine may have an integral self-propelled propulsion module attached thereto to provide additional thrust and traction to the mining machine.

11 Claims, 17 Drawing Sheets

MINING MACHINE WITH MULTIPLE PROPULSION MEMBERS

BACKGROUND OF THE INVENTION

1. Field of the Invention

The present invention relates to apparatus for mining materials from underground seams and, more particularly, is directed to self-propelled mining machines.

2. Description of the Invention Background

There are many methods in existence for mining coal and other materials from underground seams. One method that is commonly employed for mining materials from relatively deep seams involves the development of shafts and passageways by sophisticated mining machines. As the materials are mined, shuttle cars and/or various networks of conveyors are used to transport the mined materials to the surface for eventual transport to the end user.

In locations where the coal seam is closer to the surface, another mining method known as strip mining or surface mining is commonly employed. Surface or strip mining involves removing earth, rock, gravel, etc. ("overburden") overlying the materials to be mined to expose such materials for removal from the seam utilizing standard earth moving machinery. However, coal seams are rarely located at a constant depth relative to the ground surface; a coal seam may be relatively close to the surface in one area and relatively deep in another area. In those areas where the seam exceeds a certain depth, it may not be economically feasible to remove the overburden overlying that portion of the seam. When that condition occurs, the surface mining process is discontinued leaving a pit or pits having "highwalls" of overburden that overly the adjacent unmined portions of the seam.

In the past, augers have been used to drill into the seam and auger the coal therefrom. Such an augering system typically includes a drive unit arranged adjacent to the highwall. A series of auger bits forming a bit string are attached to the drive unit which serves to rotate and force the bit string into the exposed seam. As the bit string is rotatably advanced into the seam, the coal is dislodged by cutting devices on the first bit and is augured rearwardly out of the hole into a conveying apparatus for eventual discharge into a truck or other vehicle for transporting it from the pit. As additional auger bits are added to the string, the frictional resistance to the rotation of the string increases due to the overall weight of the string and the amount of coal conveyed thereby.

In an effort to address the shortcomings associated with augers, other highwall mining systems have been developed. For example, U.S. Pat. No. 3,362,752 to Densmore discloses a mining apparatus that employs a self-propelled mining machine that is attached to a series of conveyor pipes for pneumatically transmitting the won coal to a discharge conveyor on a mobile platform located adjacent the highwall.

Another highwall mining system is disclosed in U.S. Pat. No. 2,872,170 to Alspaugh. That system includes a remote controlled self-propelled mining machine that pulls a series of interconnected cascading belt conveyors into a seam to be mined. The belt conveyors receive the won coal from the mining machine and discharge it onto a conveyor attached to a launching platform located adjacent the highwall. As the mining machine advances into the seam, the train of conveyors is lengthened by adding additional conveyors.

In both of the above-mentioned mining arrangements, the penetration achieved thereby is generally limited by the self-propelled mining machine's ability to pull the string of conveyors into the seam. As additional conveyor sections are added to the end of the conveyor string, the weight that the mining machine must pull increases. Moreover, the floor of the entry in which the mining machine is cutting can typically have a loose or muddy consistency making it difficult for the mining machine to gain traction. Thus, in many instances, such mining systems are unable to mine all of the available coal due to the mining machine's inability to fully penetrate the seam.

Over the years, various mining arrangements have been developed to address such problems. For example, U.S. Pat. No. 3,135,502 to Muehlman discloses a mining system that utilizes self-propelled conveyors to aid the mining machine's advancement into the seam. Also, the train of conveyors is stored on a spiral storage track mounted to a launching platform located adjacent the highwall. Muehlman teaches that the forward thrust of the mining machine is assisted by gravity acting upon the elevated conveyor train located on the spiral track. However, the length of the conveyor train is limited by the amount of storage capacity provided on the spiral track.

Other highwall mining apparatuses are disclosed in U.S. Pat. Nos. 5,112,111, 5,232,269, 5,261,729 and 5,364,171 to Addington et al. These patents show a highwall mining system that includes a self-propelled mining machine that is adapted to pull a series of interconnected cascading belt conveyors into the seam.

While these systems generally achieve better penetration than the mining systems of the past, they require the use of large launch vehicles which are expensive and difficult to transport from mine pit to mine pit. Furthermore, mining apparatuses of the type described above are typically ill-suited for mining seams that extend at a downward angle. That is, when mining "downdipping" seams, the weight of the conveyor string in combination with the force of gravity tends to cause the mining machine to advance into the seam at an undesirable rate which can cause damage to the machine and conveyor train and even, at times, cause the mining machine to exit the seam.

Thus, there is a need for a highwall mining apparatus that can achieve improved penetration without, necessarily, needing additional thrust from a launch vehicle located adjacent the highwall.

There is a further need for a self-propelled mining machine that has a length that is longer than prior mining machines to assist in maintaining the machine's advancement in a straight line.

There is yet another need for a mining machine with the above-mentioned attributes that is capable of negotiating undulations in the mine floor without compromising its ability to be advanced in a straight line.

There is still another need for a mining apparatus that can resist the forces generated by gravity and an attending conveyor string when mining downdipping seams.

SUMMARY OF THE INVENTION

In accordance with a particular preferred form of the present invention, there is provided a mining machine having an elongated frame member. The frame member has a front portion, a rear portion, a top portion and two lateral sides. A mining member is operably attached to the front portion of the elongated frame member for dislodging material from a seam upon contact therewith to form an entry therein having a floor, a roof and two side walls. At least one first propulsion member is attached to the elongated frame member for propelling the mining machine on a surface. At least one second propulsion member is pivotally attached to the elongated frame member and is selectively pivotable between a first retracted position adjacent the top portion of the frame member and a second extended position wherein the second propulsion member engages the roof of the entry to provide additional propulsion to the mining machine. A pivot member is attached to the elongated frame member and the second propulsion member for selectively pivoting the second propulsion member between the first retracted position and the second extended position. A conveyor assembly is operably supported on the elongated frame member for conveying the dislodged material from the front portion of the elongated frame member to the rear portion thereof for discharge therefrom.

In accordance with another preferred form of the present invention there is provided a mining machine that has an elongated frame member that has a front portion, a rear portion, a top portion and two lateral sides. A mining assembly is operably attached to the front portion of the elongated frame member for dislodging material from a seam upon contact therewith to form an entry therein having a floor, a roof and two side walls. At least one first propulsion member is attached to the elongated frame member and is adapted to propel the mining machine on a surface. At least one second propulsion member is pivotally attached to each corresponding lateral side of the elongated frame member. Each second propulsion member is selectively pivotable between a first extended position wherein it engages a corresponding side wall of said entry and a second retracted position wherein it is adjacent the corresponding lateral side of the elongated frame member and wherein it does not engage the corresponding side wall of the entry. A pivot member is attached to the elongated frame member and each second propulsion member for selectively pivoting each second propulsion means between the first extended position and the second retracted position. The mining machine also includes a conveying assembly that is operably supported on the elongated frame member for conveying the dislodged material from the front portion of the elongated frame member to the rear portion thereof for discharge therefrom.

In accordance with yet another preferred form of the present invention there is provided a mining machine that has an elongated frame member that has a front portion, a rear portion, a top portion, two lateral sides and a longitudinal axis extending the length thereof. A mining assembly is operably attached to the front portion of the elongated frame member for dislodging material from a seam upon contact therewith. At least one first propulsion member is attached to the elongated frame member for propelling the mining machine on a surface. An integral propulsion module is pivotably attached to the rear portion of the elongated frame such that the propulsion module can pivot relative to the elongated frame member about a pivot axis that is substantially transverse to the longitudinal axis of the frame member. The propulsion module has a front portion, a rear portion and two lateral side portions and has second propulsion members attached thereto for propelling the propulsion module on a surface and providing additional propulsion to the elongated frame member. A conveying assembly is operably supported on the elongated frame member and the propulsion module for conveying the dislodged material from the front portion of the elongated frame member to the rear portion of the propulsion module for discharge therefrom.

It is an object of the present invention to provide apparatus that can achieve deeper penetrations in highwall mining applications without the use of large and expensive thrust producing apparatus located adjacent the highwall.

It is yet another object of the present invention to provide mining apparatus that can be advanced in a straight line and negotiate undulations in the entry floor during advancement.

Another object of the present invention is to provide a mining apparatus that has means for controlling its advancement into downdipping seams.

Accordingly, the present invention provides solutions to the aforementioned problems encountered when utilizing prior self-propelled mining machines in highwall mining applications. However, the above-mentioned details, objects and advantages will become apparent as the following detailed description of the present preferred embodiment thereof proceeds.

BRIEF DESCRIPTION OF THE DRAWINGS

In the accompanying drawings, there are shown present preferred embodiments of the invention wherein like reference numerals are employed to designate like parts and wherein.

DETAILED DESCRIPTION OF THE PREFERRED EMBODIMENTS

Figure 1:
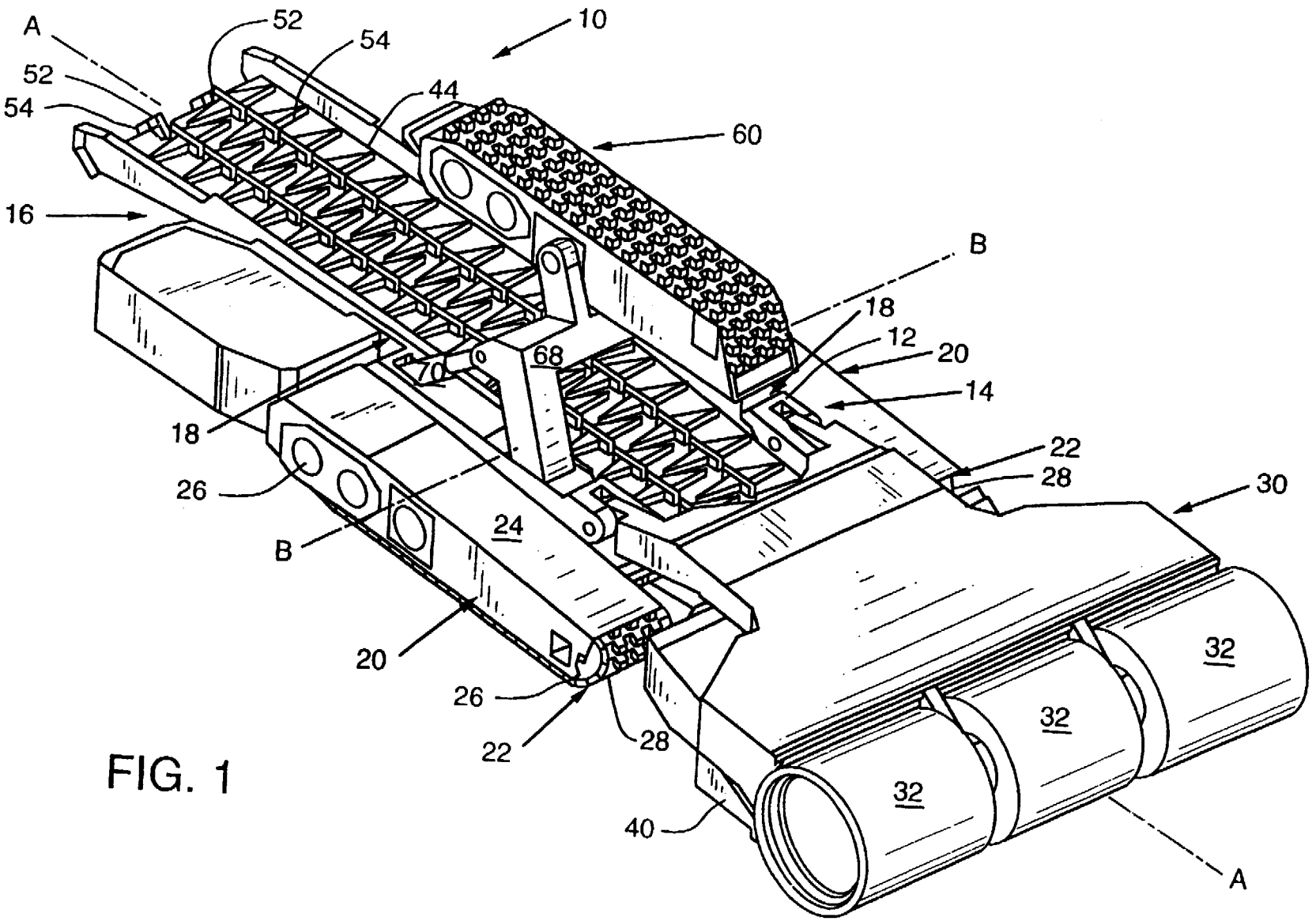
FIG. 1 is a perspective view of a preferred mining machine of the present invention.

Referring now to the drawings for the purposes of illustrating the present preferred embodiments of the invention only and not for purposes of limiting the same, the Figures show a self-propelled mining machine generally designated as 10. While the mining machine 10 is well-adapted for use in highwall mining applications, the skilled artisan will appreciate that the subject mining machine 10 can be as equally effective in underground mines or similar applications. Accordingly, the subject invention should not be limited to use solely in connection with highwall mining operations.

More particularly and with reference to FIG. 1, there is shown a mining machine 10 that includes an elongated frame 12 that has a front portion 14, a rear portion 16 and two lateral sides 18. A ground engaging traction member 20, in the form of an independently driven endless track assembly 22, is operably attached to each lateral side 18 of the frame 12. Such endless track assemblies 22 are known in the art and, as such, will not be discussed in great detail herein. However, the reader will appreciate that each endless track assembly 22 includes a frame 24 that operably supports a pair of sprocket assemblies 26. At least one sprocket assembly 26 is powered by a commercially available, electrically powered motor for rotating the sprocket assembly 26 in a known manner under control of an operator having suitable operator controls. In a preferred embodiment, a motor manufactured by Reliance Electric of Route 2, Box 560, 101 Reliance Road, Kings Mountain, N.C., USA under Model No. 48J9 serves to power one sprocket assembly 26, while the second sprocket assembly 26 is, for the most part, freewheeling.

A conventional ground engaging track 28 is trained on the sprocket assemblies 26 and is adapted for orbital travel thereon. The skilled artisan will readily appreciate that when rotated in one direction, the ground engaging tracks 28 will propel the mining machine 10 forward and when the rotational direction of the tracks 28 is reversed, the mining machine 10 will be propelled in the opposite direction.

Figure 2:
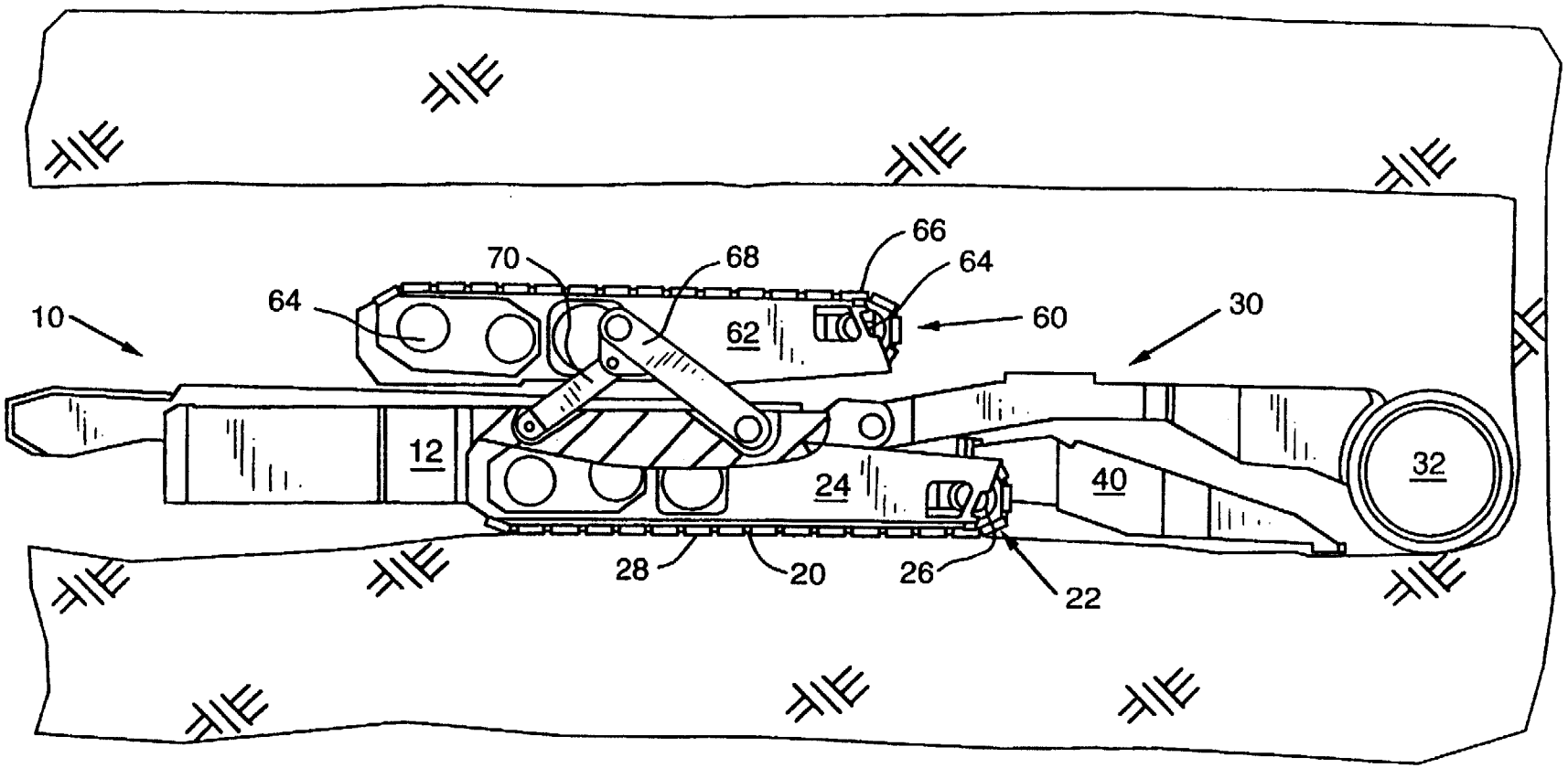
FIG. 2 is a side elevational view of the mining machine of FIG. 1 with a portion thereof shown in cross-section and the third track assembly thereof in a first retracted position.
Figure 3:
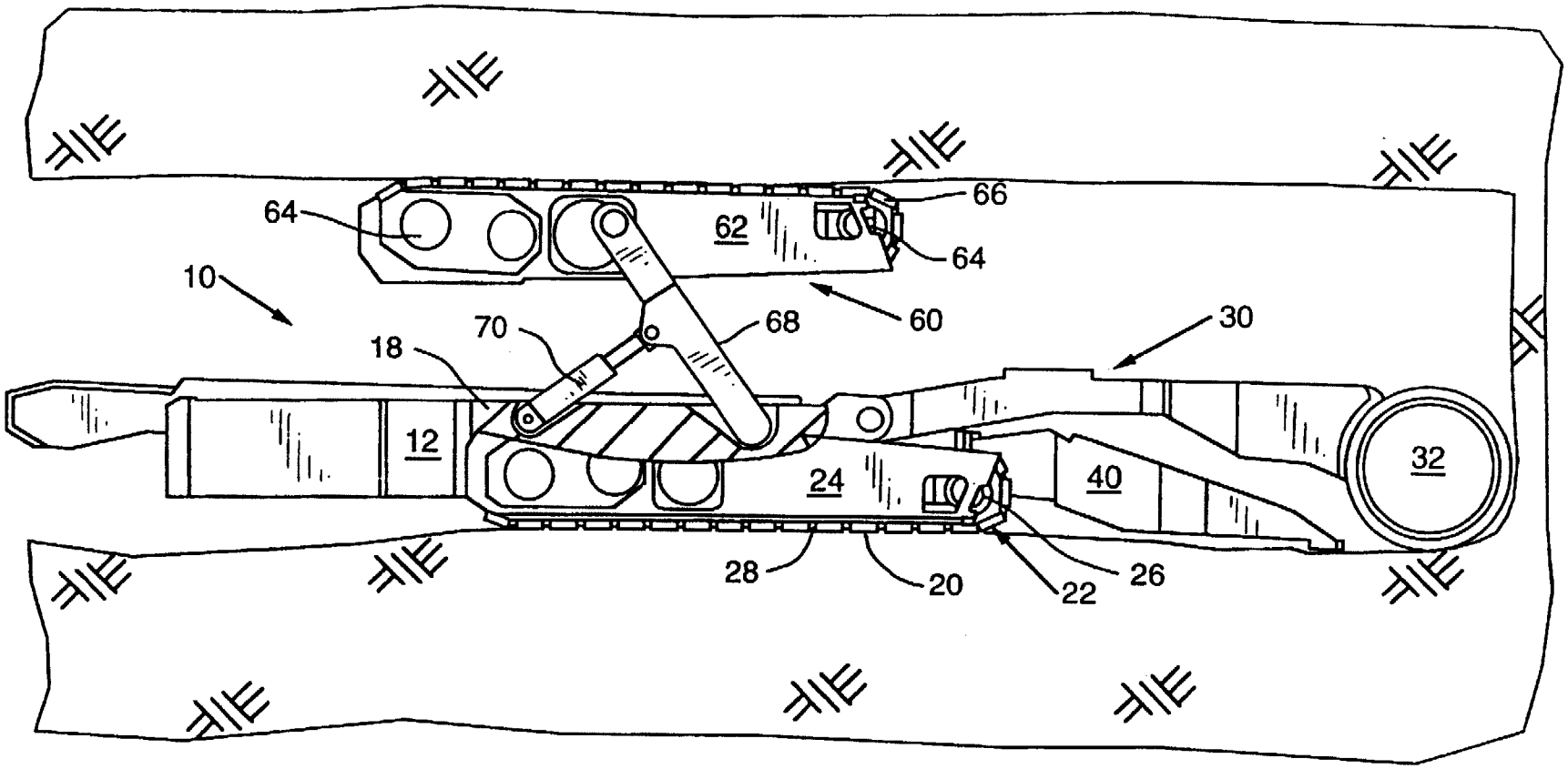
FIG. 3 is a side elevational view of the mining machine of FIGS. 1 and 2 with a portion thereof shown in cross-section and the third track assembly thereof in a second extended position.

A cutter boom assembly 30 is preferably pivotally attached to the front portion 14 of the elongated miner frame 12 as shown in FIG. 1. The construction of such cutter boom assembly 30 is known in the art and, therefore, will not be discussed in great detail herein. As can be seen in FIGS. 1 and 2, preferably three cutting drums 32 are operably attached to the front of the boom assembly 30. Such cutting drums 32 function in the same manner as the cutter heads on conventional continuous mining machines. Thus, it will be appreciated that a number of different cutter head arrangements could be successfully employed. The particular configuration most suitable for a given application is determined by a number of factors, one of which is the thickness of the coal seam and the appropriate width of the mined hole to be cut. Some cutter heads are driven by hydraulic motors and others are driven by electric motors in a known fashion. Typically, the larger cutting heads are electrically driven due to their ability to develop greater torque and power while the smaller heads are often hydraulically driven.

In a preferred embodiment, the cutting drums 32 are driven by an electric motor manufactured by Reliance Electric under Model No. 20B350J. However, a number of other drive arrangements can be successfully used. The reader will appreciate that the cutting drums 32 are equipped with a series of mining bits (not shown) that serve to dislodge the coal from the seam when they are advanced into contact therewith. As the mining bits dislodge the coal from the seam, the coal drops to the base of the mine face. In a preferred embodiment, a gathering pan 40 is attached to the front portion 14 of the elongated frame 12 for gathering the coal dislodged by the mining bits.

Figure 4:
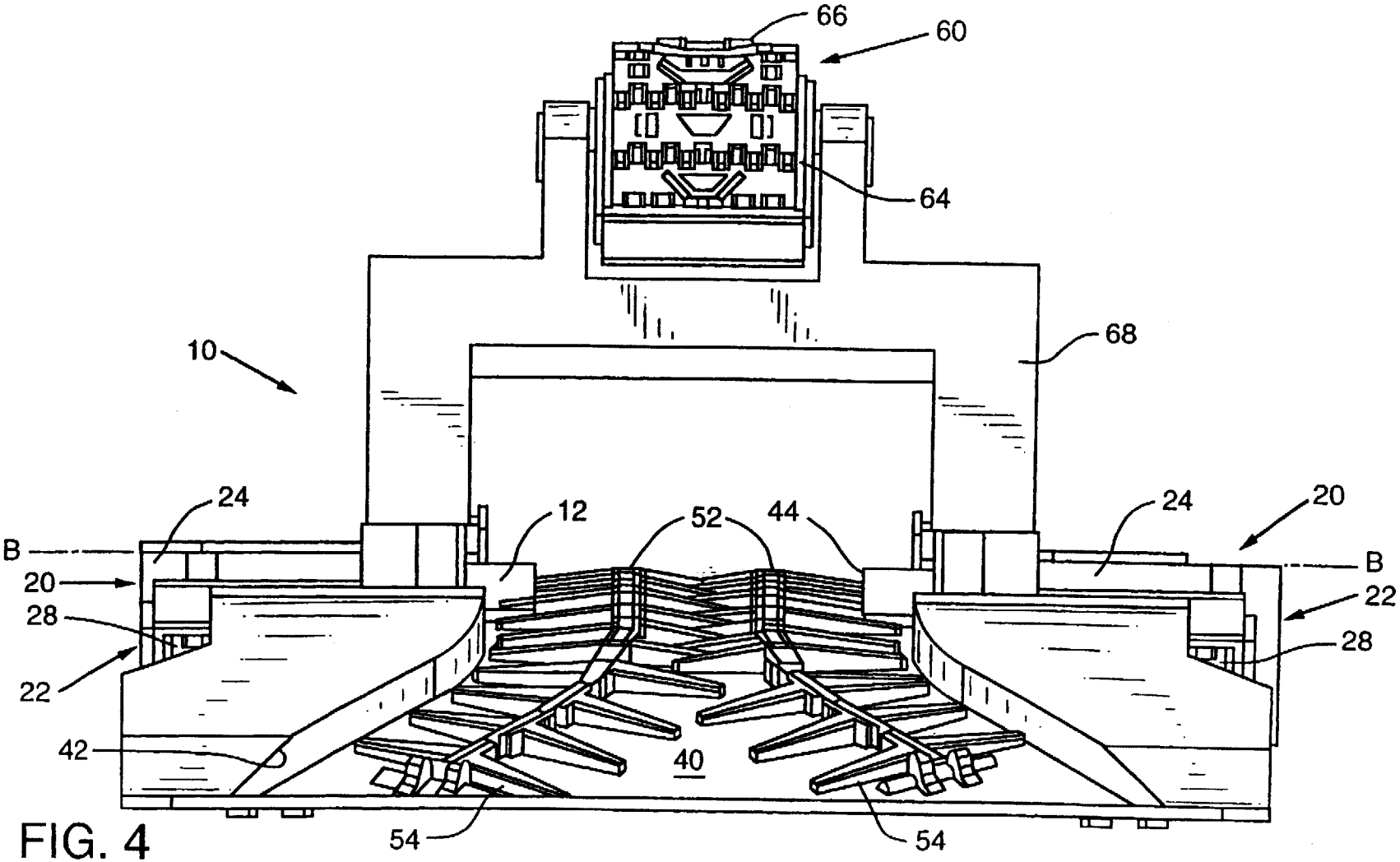
FIG. 4 is a front elevational view of the mining machine of FIGS. 1–3 with the cutting boom assembly thereof omitted for clarity.

More specifically and with reference to FIG. 4, the gathering pan 40 is provided with a widened conveying channel 42 that interfaces with a corresponding elongated channel 44 that extends the entire length of the machine 10. Two endless chain conveyors 50 are preferably operably supported within the channels (42, 44). The chain conveyors 50 are of a conventional type and each include an endless chain 52 that is entrained on sprockets, at least one of which is driven by a conventional electrically or hydraulically powered motor. Attached to each chain 52 are a series of scraper pads 54 that serve to urge and force the coal that falls onto the gathering pan 40 to the rear of the machine for discharge into an attending conveying apparatus (not shown).

In this embodiment, at least one third track assembly 60 is preferably pivotally attached to the miner frame 12 such that it can be selectively brought into engagement with the entry roof to increase the mining machine's tractive effort. The third track assembly 60 is preferably constructed in the same manner as the track assemblies 22 and includes a frame 62 that supports a pair of sprocket assemblies 64, at least one of which is driven. An endless track 66, of conventional design, is trained on the sprocket assemblies 64 for orbital travel thereon.

The endless track assembly 60 is preferably pivotally mounted (i.e., pinned) to a frame member 68. Frame member 68 is pinned to the miner frame 12 on each side of the conveyor 50. At least one, and preferably two, hydraulic cylinders 70 are attached to the miner frame 12 and the frame member 68 for selectively pivoting the frame member 68 about axis B—B that is transverse to the miner's longitudinal axis A—A. See FIGS. 1 and 2. The skilled artisan will appreciate that by extending the pistons of cylinders 70, the track assembly 60 can be brought into engagement with the entry roof and by retracting the pistons, the track assembly 60 can be moved to a position adjacent the top of the miner frame 12. It will be further appreciated that when in the retracted position, the track assembly 60 will not obstruct or prevent the operation of conveyor 50.

In this embodiment, the mining machine 10 is controlled by an operator located adjacent the highwall utilizing conventional remote control techniques. When beginning the mining process, the track assembly 60 is retained in the retracted position and the track assemblies 22 are used to advance the mining machine 10 into the seam. After the mining machine 10 has advanced into the seam far enough to enable the track assembly 60 to be brought into engagement with the entry roof, the cylinders 70 are extended to cause the track assembly 60 to engage the roof. The track assembly 60 is then powered to provide additional tractive effort to the mining machine 10. After the mining machine 10 has mined into the entry a desired distance, the direction of rotation of the endless tracks on the track assemblies (22, 60) are reversed to cause the machine 10 to back out of the entry. In downdipping seam applications, the endless track 60, when engaging the entry roof, can serve to "brake" the mining machine's advancement into the seam.

Another preferred embodiment of the present invention is depicted in FIGS. 5–9. As can be seen in those Figures, the invention comprises a mining machine 110 that includes an elongated frame 112 that has a front portion 114, a rear portion 116 and two lateral sides 118. A ground engaging traction member 120, in the form of an independently driven endless track assembly 122 is operably attached to each lateral side 118 of the frame 112. Such endless track assemblies 122 are known in the art and, as such, will not be discussed in great detail herein. However, the reader will appreciate that each endless track assembly 122 includes a frame 124 that operably supports a pair of sprocket assemblies 126. At least one sprocket assembly 126 is powered by a commercially available, electrically or hydraulically powered motor for rotating the sprocket assembly 126 in a known manner. In a preferred embodiment, a motor manufactured by Reliance Electric under Model No. 48J9 serves to power one sprocket assembly, while the second sprocket assembly 126 is, for the most part, freewheeling.

A conventional ground engaging track 128 is trained on the sprocket assemblies 126 and is adapted for orbital travel thereon. The skilled artisan will readily appreciate that when rotated in one direction, the ground engaging tracks 128 will propel the mining machine 110 forward and when the rotational direction of the tracks 128 is reversed, the mining machine 110 will be propelled in the opposite direction.

Figure 5:
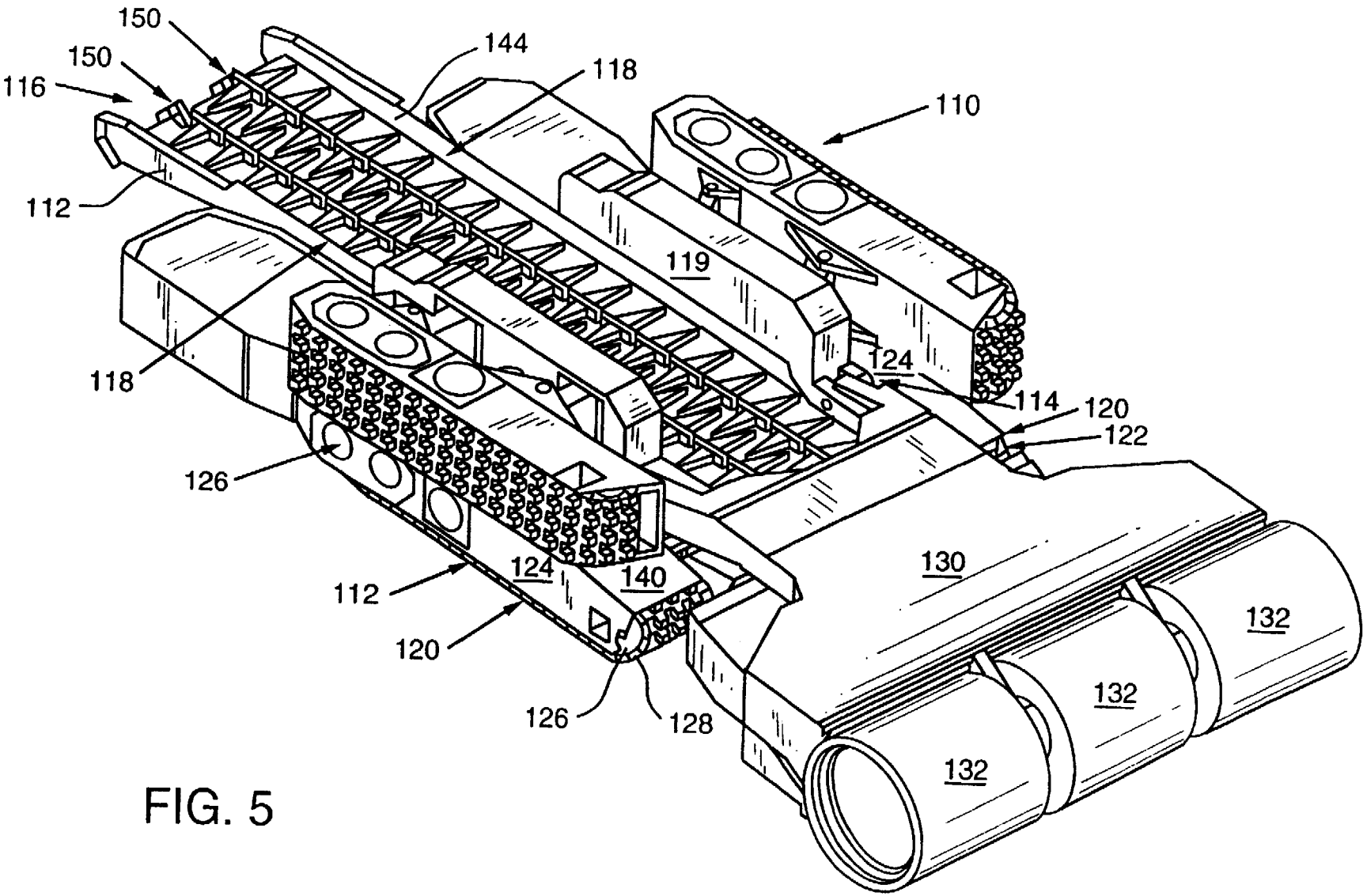
FIG. 5 is a perspective view of another preferred mining machine of the present invention.

A cutter boom assembly 130 is pivotally attached to the front portion 114 of the elongated miner frame 112. The construction of such cutter boom assembly 130 is known in the art and, therefore, will not be discussed in great detail herein. As can be seen in FIG. 5, preferably three cutting drums 132 are operably attached to the front of the boom assembly 130. Such cutting drums 132 function in the same manner as the cutter heads on conventional continuous mining machines. Thus, it will be appreciated that a number of different cutter head arrangements could be successfully employed.

In a preferred embodiment, the cutting drums 132 are driven by an electric motor manufactured by Reliance Electric under Model No. 20B350J. However, a number of other drive arrangements can be successfully used. The reader will further appreciate that the cutting drums 132 are equipped with a series of mining bits (not shown) that serve to dislodge the coal from the seam when they are advanced into contact therewith. As the mining bits dislodge the coal from the seam, the coal drops to the base of the mine face. In a preferred embodiment, a gathering pan 140 is attached to the front portion 114 of the elongated frame 112 for gathering the won coal.

Figure 6:
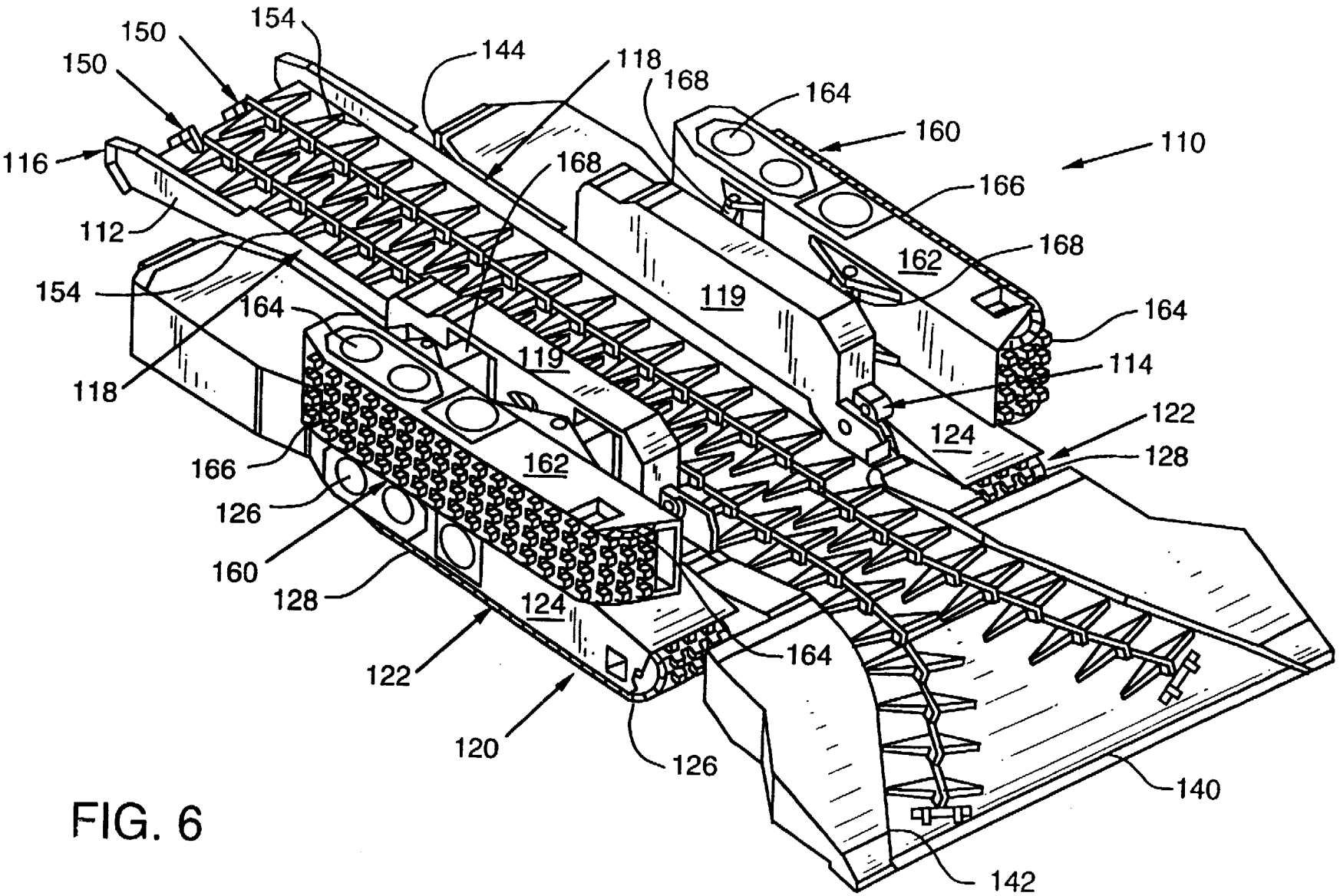
FIG. 6 is a perspective view of the mining machine of FIG. 5 with the cutting boom assembly thereof omitted for clarity.
Figure 9:
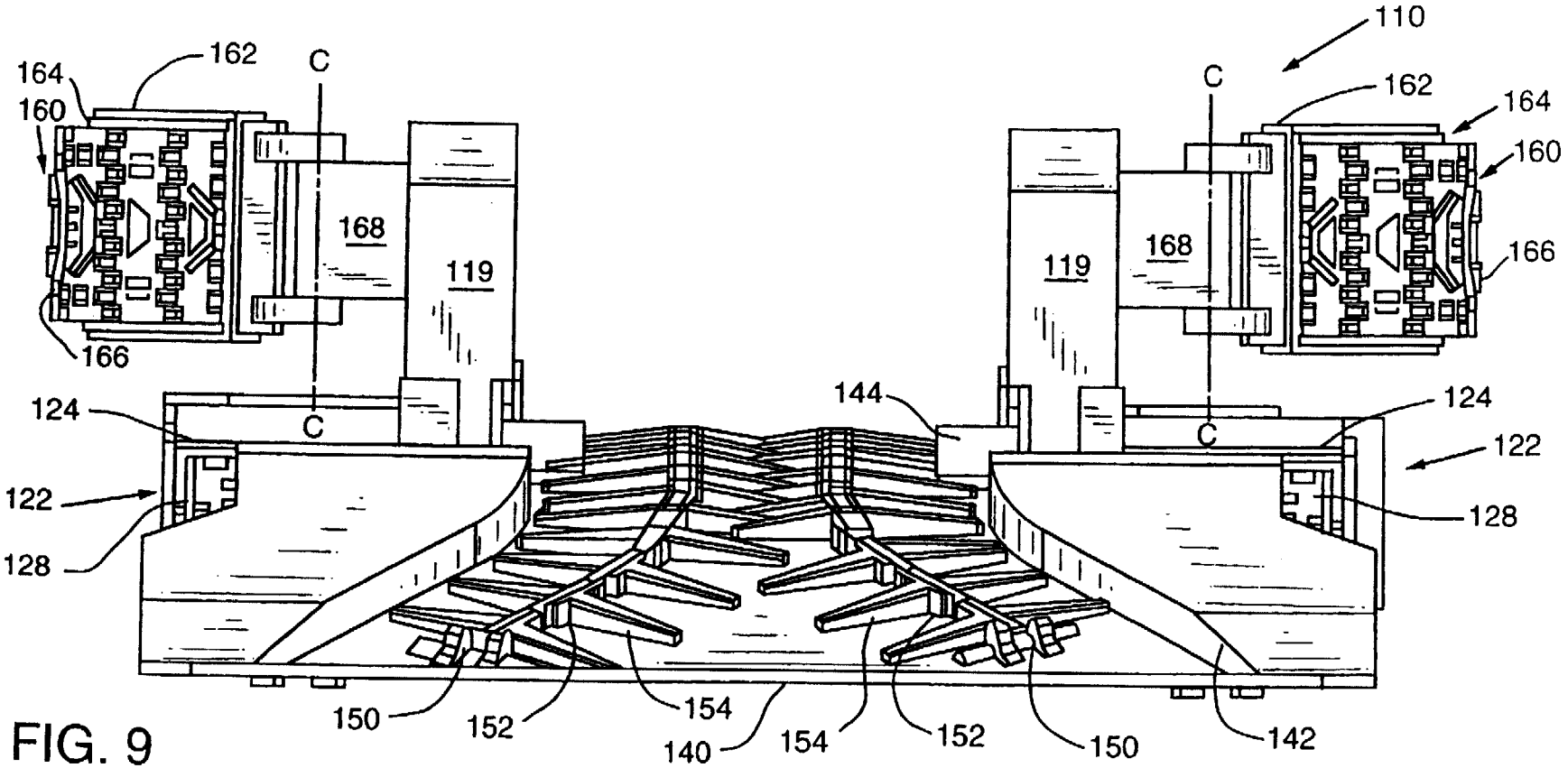
FIG. 9 is a front elevational view of the mining machine of FIGS. 5–8 with the cutting boom assembly thereof omitted for clarity.

More specifically and with reference to FIGS. 6 and 9, the gathering pan 140 is provided with a widened conveying channel 142 that interfaces with a corresponding elongated channel 144 that extends the entire length of the machine 110. Two endless chain conveyors 150 are preferably operably supported within the channels (142, 144). The chain conveyors 150 are of a conventional type and each include an endless chain 152 that is entrained on sprockets, at least one of which is driven. Attached to each chain 152 are a series of scraper pads 154 that serve to urge and force the coal that falls onto the gathering pan 140 to the rear of the machine 110 for discharge into an attending conveying apparatus (not shown).

In this embodiment, an auxiliary track assembly 160 is pivotally attached to each lateral side 18 of the miner frame 112 such that each of the auxiliary track assemblies 160 can be selectively brought into engagement with the sides of the entry to increase the mining machine's tractive effort. See FIG. 8. The auxiliary track assemblies 160 are each preferably constructed in the same manner as the track assemblies 122. Each track assembly 160 includes a frame 162 that supports a pair of sprocket assemblies 164, at least one of which is driven. An endless track 166, of conventional design, is trained on the sprocket assemblies 164 for orbital travel thereon.

Figure 7:
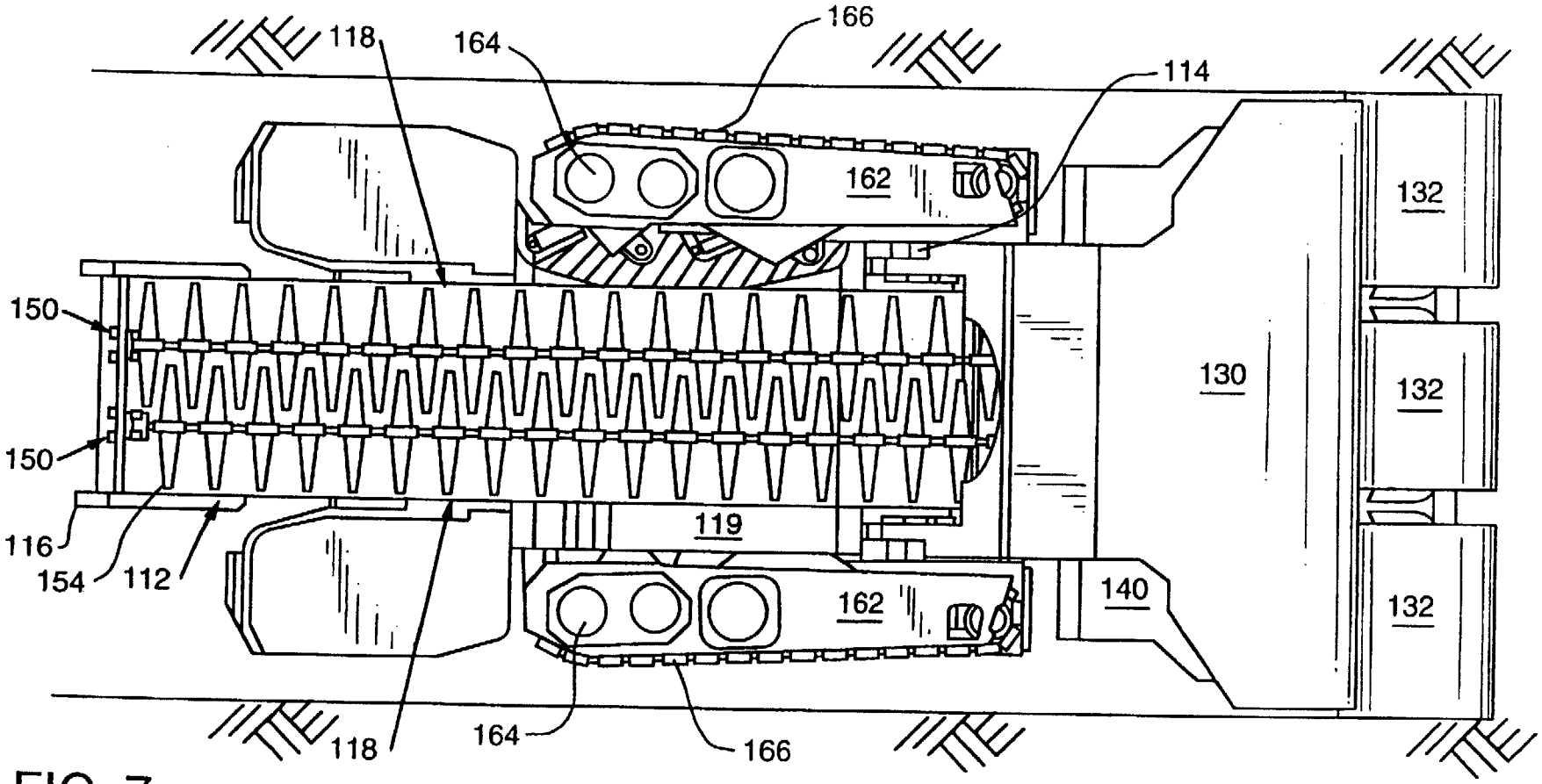
FIG. 7 is a top view of the mining machine of FIGS. 5 and 6 with the auxiliary track assemblies thereof in retracted positions.
Figure 8:
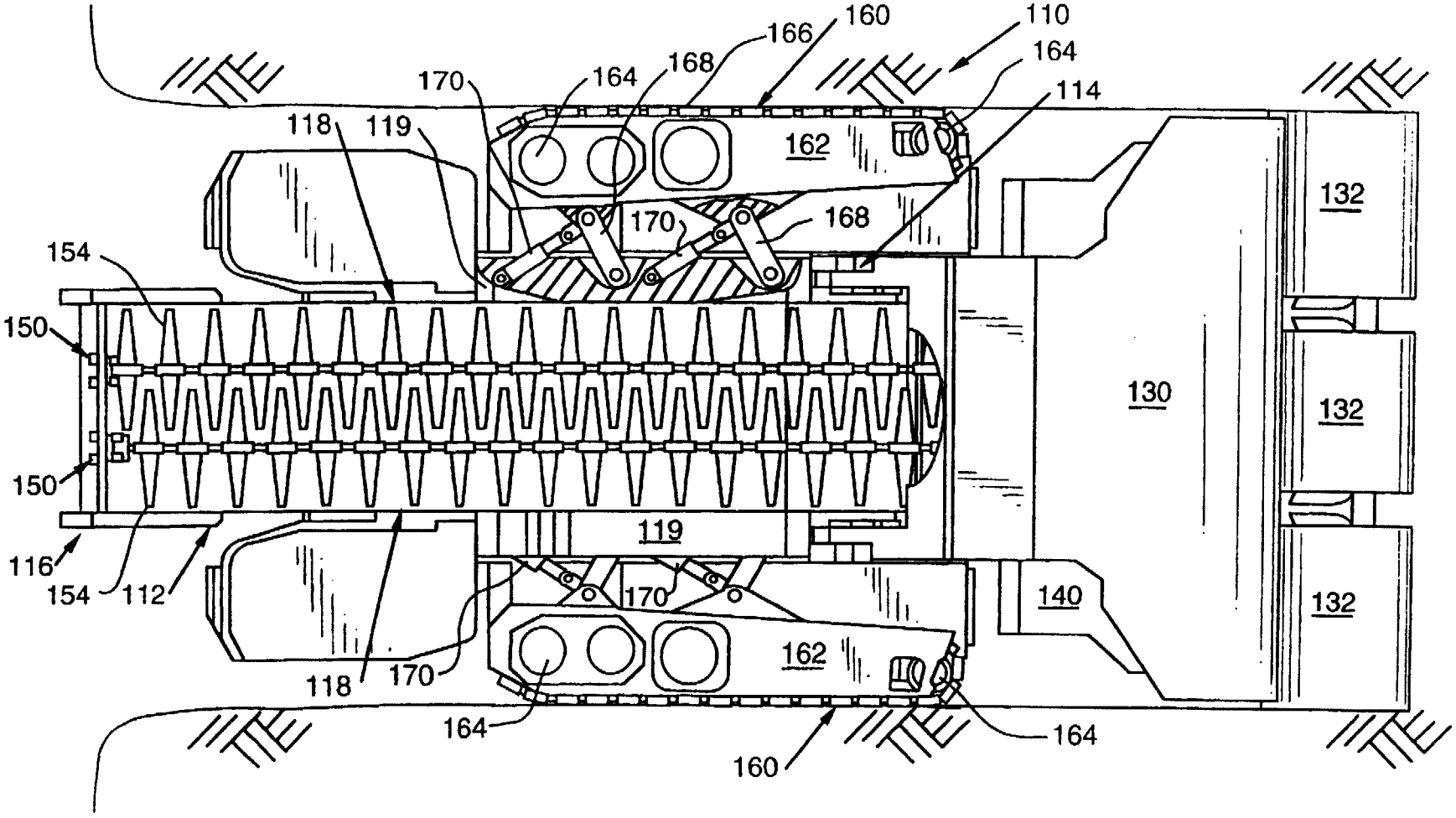
FIG. 8 is a top view of the mining machine of FIGS. 5–7 with the auxiliary track assemblies thereof in extended positions.

As can be seen in FIGS. 5–9, an upstanding support member 119 is attached to each lateral side 118 of the elongated miner frame 112. The endless track assemblies 160 are pivotally mounted (i.e., pinned) to a pair of corresponding bracket members 168 that are pinned to the upstanding support members 119. See FIG. 8. A hydraulic cylinder 170 is attached to each bracket 168 for selectively pivoting the bracket member 168 about axes C—C. See FIG. 9. The skilled artisan will appreciate that by extending the pistons of cylinders 170, the track assemblies 160 can be brought into engagement with the corresponding sides of the entry (FIG. 8) and by retracting the pistons, the track assemblies 160 can be moved to positions adjacent the lateral sides 118 of the miner frame 12 (FIG. 7).

This embodiment of the present invention is controlled by an operator located adjacent the highwall utilizing conventional remote control apparatuses and techniques. When beginning the mining process, the track assemblies 160 are retained in retracted positions until the mining machine 110 has advanced into the entry far enough to enable the track assemblies 160 to be brought into engagement with the walls of the entry. Thereafter, one or both of the track assemblies 160 are brought into engagement with the corresponding entry wall by extending the corresponding cylinders 170. The track assemblies 160 that have engaged the entry walls are then powered to provide additional tractive effort to the mining machine 110. After the mining machine 10 has mined into the entry a desired distance, the direction of rotation of the endless tracks on the track assemblies (122, 160) are reversed to cause the machine 110 to back out of the entry. The skilled artisan will appreciate that the track assemblies 160 can be used to control and retard the mining machine's advancement in downdipping seams.

Figure 10:
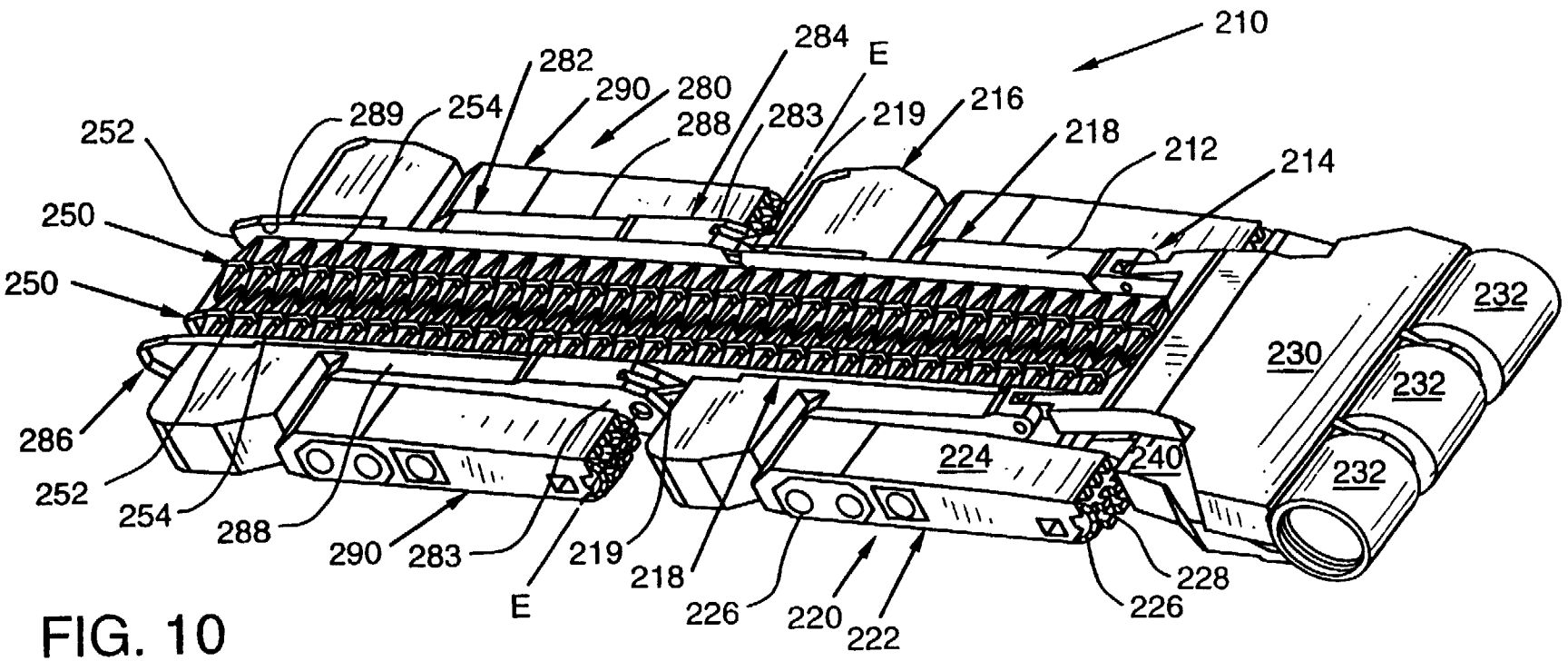
FIG. 10 is a perspective view of another preferred mining machine of the subject invention.
Figure 11:
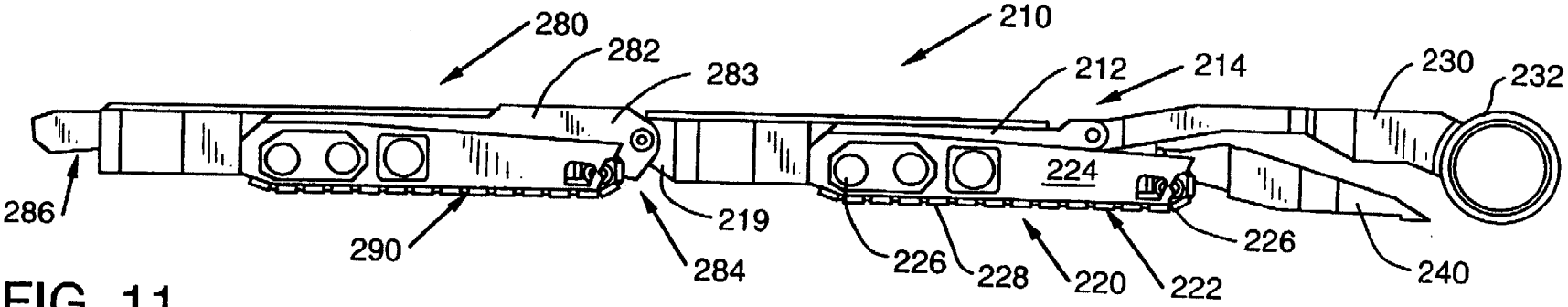
FIG. 11 is a side elevational view of the mining machine of FIG. 10.
Figure 12:
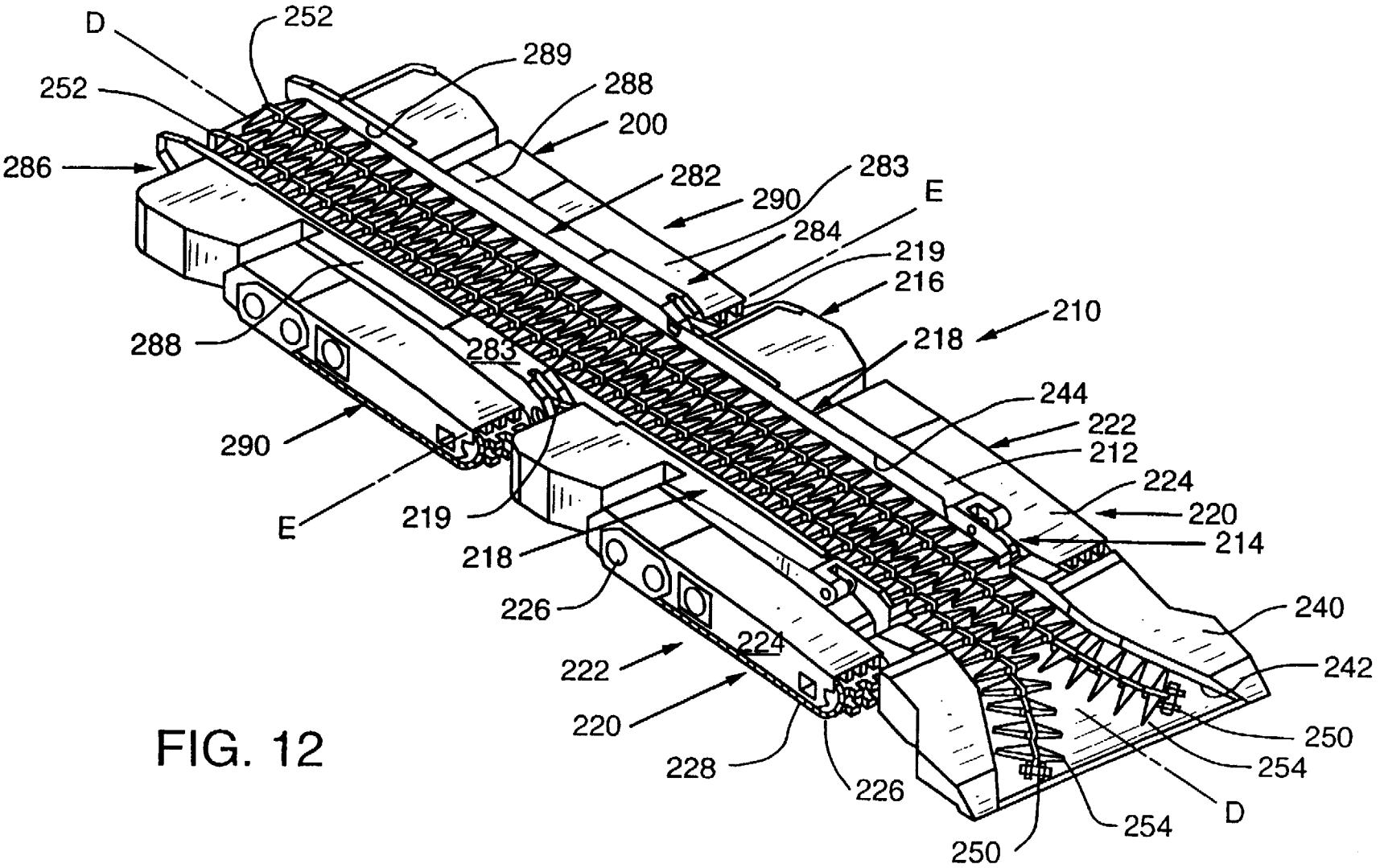
FIG. 12 is a perspective view of the mining machine of FIGS. 10 and 11 with the cutting boom assembly thereof omitted for clarity.

Yet another preferred embodiment of the present invention is depicted in FIGS. 10–12. As can be seen in those Figures, the invention comprises a mining machine 210 that includes an elongated frame 212 that has a front portion 214, a rear portion 216 and two lateral sides 218. A ground engaging traction member 220, in the form of an independently driven endless track assembly 222, is operably attached to each lateral side 218 of the frame 212. Such endless track assemblies 222 are known in the art and, as such, will not be discussed in great detail herein. However, the reader will appreciate that each endless track assembly 222 includes a frame 224 that operably supports a pair of sprocket assemblies 226. At least one sprocket assembly 226 is powered by a commercially available, electrically or hydraulically powered motor for rotating the sprocket assembly 226 in a known manner. In a preferred embodiment, a motor manufactured by Reliance Electric under Model No. 48J9 serves to power one sprocket assembly, while the second sprocket assembly 226 is, for the most part, freewheeling.

A conventional ground engaging track 228 is trained on the sprocket assemblies 226 and is adapted for orbital travel thereon. The skilled artisan will readily appreciate that when rotated in one direction, the ground engaging tracks 228 will propel the mining machine 210 forward and when the rotational direction of the tracks 228 is reversed, the mining machine 210 will be propelled in the opposite direction.

In this embodiment, an auxiliary propulsion module 280 is pivotally attached (i.e., pinned) to the rear portion 216 of the frame 212 such that the propulsion module 280 can only pivot relative to the frame 212 about an axis E—E that is substantially transverse to the longitudinal axis D—D of the machine 210. Preferably, propulsion module 280 has an elongated frame 282 that has a front portion 284, a rear portion 286 and two lateral sides 288. A traction assembly 290 is attached to each lateral side 288 of the auxiliary propulsion module 280. The traction assemblies 290 are substantially identical in construction as the traction assemblies described above.

As can be seen in FIGS. 10 and 12, the frame assembly 282 serves to define a conveyor trough 289 that extends the length of the propulsion module 280. To pivotally attach the propulsion module 280 to the frame 212 of the mining machine 210, the mining machine frame 212 is preferably equipped with a pair of attachment tongues 219 that are adapted to be received in corresponding clevis assemblies 283 attached to the front portion 284 of the frame 282 of the propulsion module 280. Each tongue 219 is then pinned to its corresponding clevis assembly 283 in a conventional manner.

A cutter boom assembly 230 is pivotally attached to the front portion 214 of the elongated miner frame 212. The construction of such cutter boom assembly 230 is known in the art and, therefore, will not be discussed in great detail herein. As can be seen in FIG. 10, preferably three cutting drums 232 are operably attached to the front of the boom assembly 230. Such cutting drums 232 function in the same manner as the cutter heads on conventional continuous mining machines. Thus, it will be appreciated that a number of different cutter head arrangements could be successfully employed.

In a preferred embodiment, the cutting drums 232 are driven by an electric motor manufactured by Reliance Electric under Model No. 20B350J. However, a number of other drive arrangements can be successfully used. The reader will appreciate that the cutting drums 232 are equipped with a series of mining bits (not shown) that serve to dislodge the coal from the seam when they are advanced into contact therewith. As the mining bits dislodge the coal from the seam, the coal drops to the base of the mine face. In a preferred embodiment, a gathering pan 240 is attached to the front portion 214 of the elongated frame 212 for gathering the "won" coal.

More specifically and with reference to FIG. 12, the gathering pan 240 is provided with a widened conveying channel 242 that interfaces with a corresponding elongated channel 244 that extends the entire length of the machine 210. Two endless chain conveyors 250 are preferably operably supported within the channels (242, 244). The chain conveyors 250 are of a conventional type and each include an endless chain 252 that is entrained on sprockets, at least one of which is driven. Attached to each chain 252 are a series of scraper pads 254 that serve to urge and force the coal that falls onto the gathering pan 240 to the rear of the auxiliary propulsion module 280 for discharge onto an attending conveying apparatus (not shown).

The skilled artisan will readily appreciate that this embodiment of the present invention is remote controlled by an operator located adjacent the highwall utilizing conventional remote control apparatuses and techniques and provides improved propulsion over prior mining machine designs. While the unique pivoting arrangement between the propulsion module 280 and the mining machine 212 enables the unit to accommodate undulations in the entry floor, the increased length of the unit serves to facilitate its advancement into the seam in a substantially straight line.

Another preferred embodiment of the present invention is depicted in FIGS. 13–18. As can be seen in those Figures, the invention comprises a mining machine 310 that includes a mining module 312 that has an elongated frame 313. The frame 313 has a front portion 314, a rear portion 316 and two lateral sides 318. A ground engaging traction member 320, in the form of an independently driven endless track assembly 322, is operably attached to each lateral side 318 of the frame 313. Such endless track assemblies 322 are known in the art and, as such, will not be discussed in great detail herein. However, the reader will appreciate that each endless track assembly 322 includes a frame 324 that operably supports a pair of sprocket assemblies 326. At least one sprocket assembly 326 is powered by a commercially available, electrically or hydraulically powered motor for rotating the sprocket assembly 326 in a known manner. In a preferred embodiment, a motor manufactured by Reliance Electric under Model No. 48J9 serves to power one sprocket assembly, while the second sprocket assembly 326 is, for the most part, freewheeling.

A conventional ground engaging track 328 is trained on the sprocket assemblies 326 and is adapted for orbital travel thereon. The skilled artisan will readily appreciate that when rotated in one direction, the ground engaging tracks 328 will propel the mining machine 310 forward and when the rotational direction of the tracks 328 is reversed, the mining machine 310 will be propelled in the opposite direction.

Figure 13:
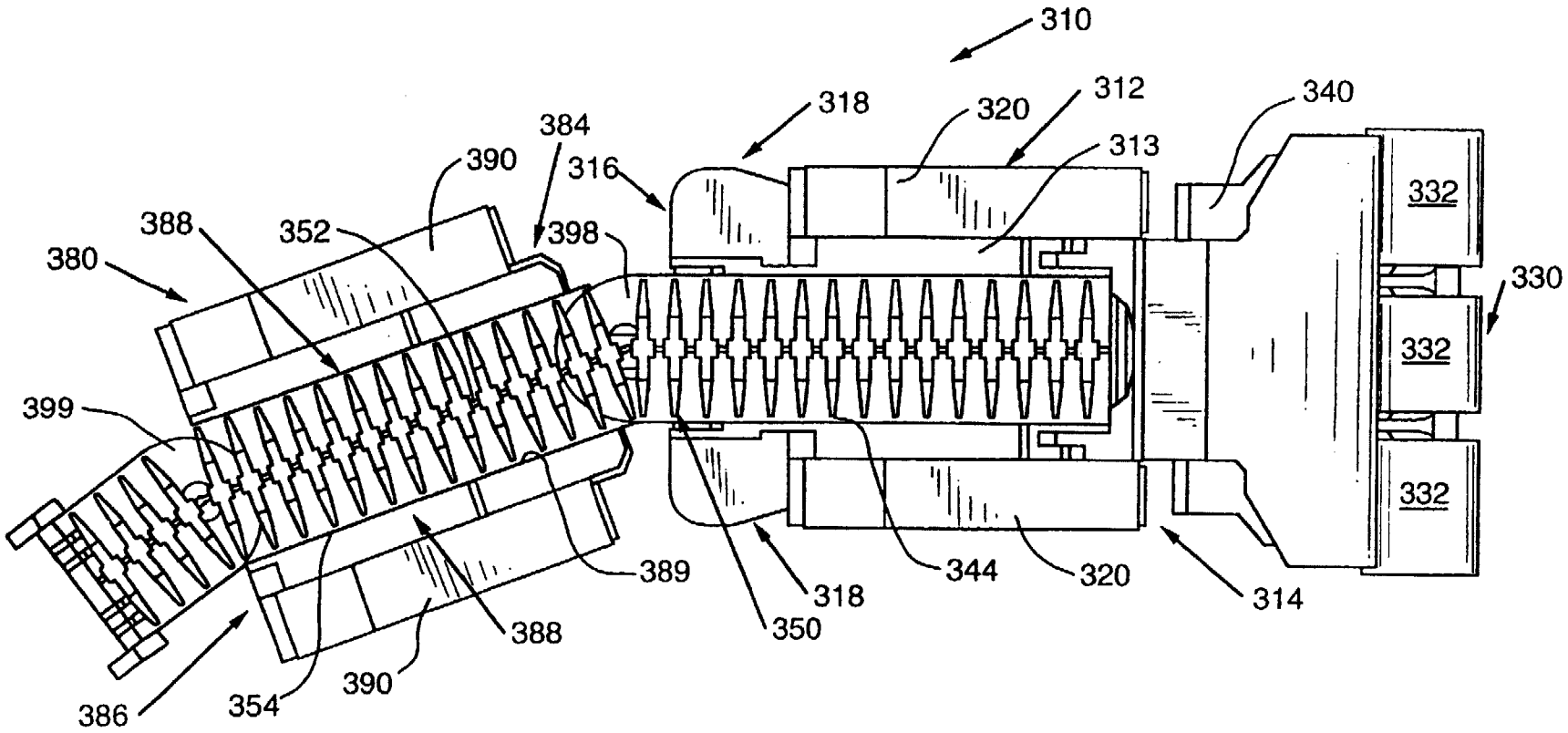
FIG. 13 is a plan view of another preferred mining machine of the present invention.
Figure 14:
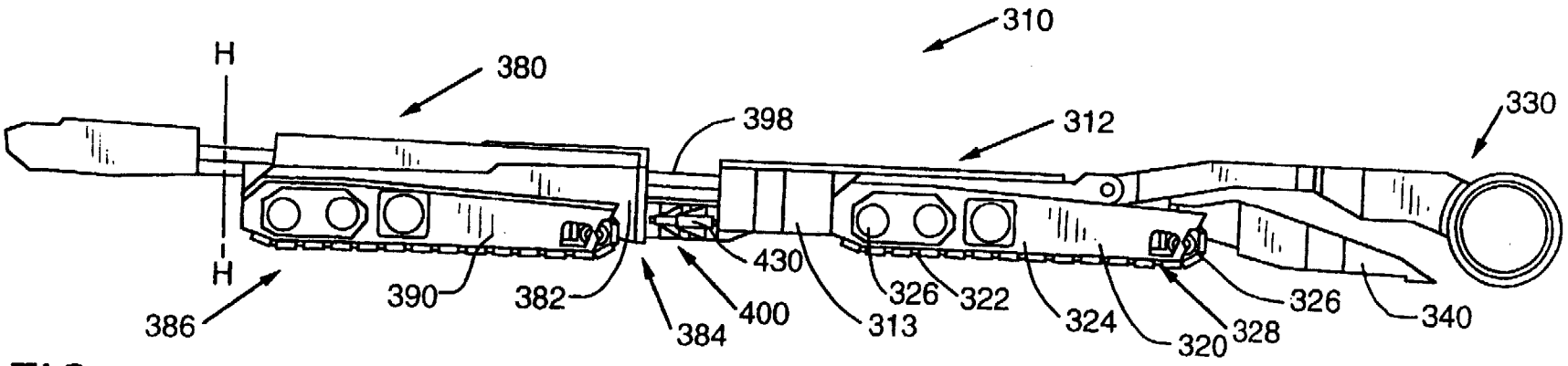
FIG. 14 is a side elevational view of the mining machine of FIG. 13.
Figure 15:
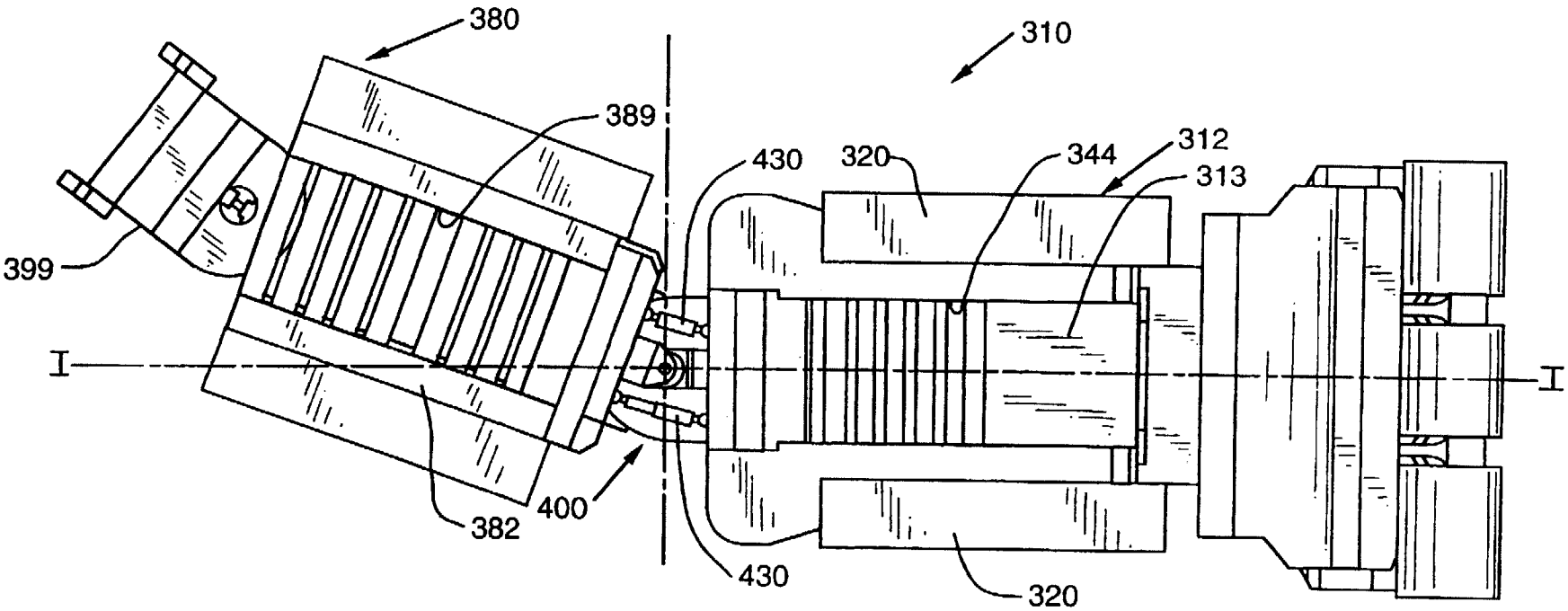
FIG. 15 is a plan view of the mining machine of FIGS. 13 and 14 with the chain conveyor components omitted for clarity.

A cutter boom assembly 330 is pivotally attached to the front portion 314 of the elongated miner frame 312. The construction of such cutter boom assembly 330 is known in the art and, therefore, will not be discussed in great detail herein. As can be seen in FIGS. 13 and 15, preferably three cutting drums 332 are operably attached to the front of the boom assembly 330. Such cutting drums 332 function in the same manner as the cutter heads on conventional continuous mining machines. Thus, it will be appreciated that a number of different cutter head arrangements could be successfully employed.

In a preferred embodiment, the cutting drums 332 are driven by an electric motor manufactured by Reliance Electric under Model No. 20B350J. However, a number of other drive arrangements can be successfully used. The reader will appreciate that the cutting drums 332 are equipped with a series of mining bits (not shown) that serve to dislodge the coal from the seam when they are advanced into contact therewith. As the mining bits dislodge the coal from the seam, the coal drops to the base of the mine face. In a preferred embodiment, a gathering pan 340 is attached to the front portion 314 of the elongated frame 313 for gathering the "won" coal. The gathering pan 340 is provided with a widened conveying channel that interfaces with a corresponding elongated channel 344 that extends the entire length of the machine 310. An endless chain conveyor 350 is preferably operably supported within the channel 344. The chain conveyor 350 is of a conventional type and includes an endless chain 352 that is entrained on sprockets, at least one of which is driven. Attached to the chain 352 are a series of scraper pads 354 that serve to urge and force the coal that falls onto the gathering pan 340 to the rear of the mining machine 310.

In this embodiment, an auxiliary propulsion module 380 is attached to the rear portion 316 of the frame 312 by a joint assembly 400. Preferably, propulsion module 380 has an elongated frame 382 that has a front portion 384, a rear portion 386 and two lateral sides 388. A traction assembly 390 is attached to each lateral side 388 of the auxiliary propulsion module 380. The traction assemblies 390 may be substantially similar in construction to the traction assemblies described above.

As can be seen in FIGS. 13 and 15, the frame assembly 382 serves to define a conveyor trough 389 that extends the length of the propulsion module 380. The conveyor trough 389 serves to operably support the endless chain conveyor 350 therein. See FIG. 13. To provide support for the conveyor chain and provide a trough for supporting the won coal as it is conveyed between the mining module 312 and the propulsion module 380, a trough extension 398 is provided on the mining module 312. The skilled artisan will appreciate, however, that the trough extension 398 is not attached to the propulsion module 380 and a sufficient amount of space is provided between the trough extension 398 and the propulsion module 380 to enable the propulsion module 380 to pivot relative to the mining module 312 about a plurality of different axes as will be discussed in further detail below. In addition, in this embodiment, a similar trough extension 399 is attached to the rear of the propulsion module 380 such that it can be selectively pivoted about a vertical axis H—H. See FIG. 14.

In this embodiment, the propulsion module 380 is attached to the mining module 312 by a universal joint assembly 400. More specifically and with reference to FIGS. 16 and 17, joint assembly 400 preferably includes a first ball bearing assembly 410 attached to the front of the propulsion member 380. Ball bearing assembly 410 preferably includes a mounting portion 412 that is rigidly attached to the frame 382 of the propulsion module 380. The ball bearing assembly 410 also includes a clevis-like attachment portion 414 that is rotatably supported by the bearings to enable it to rotate about a longitudinal axis I—I that extends through the mining machine 310. Preferably, the ball bearing joint manufactured by Rotek Incorporated of Aurora, Ohio, USA 44202 under Series No. 3000 is employed; however, other ball bearing joint arrangements can be used. In this embodiment, a second ball bearing joint 420 is attached to the frame 313 of the mining module 312. Ball bearing joint assembly 420 is preferably identical in construction as bearing assembly 410 and has a mounting portion 422 and a clevis-like attachment portion 424.

Figure 16:
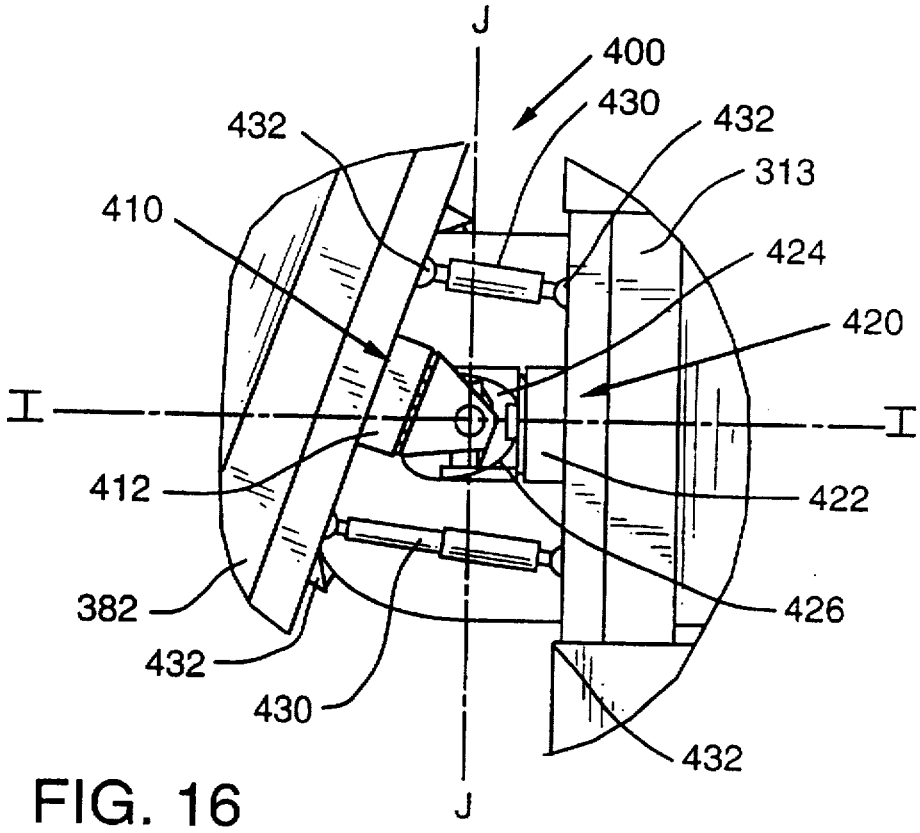
FIG. 16 is a partial plan view of the preferred joint arrangement for joining the propulsion module to the mining module of the mining machine of FIGS. 13–15.
Figure 17:
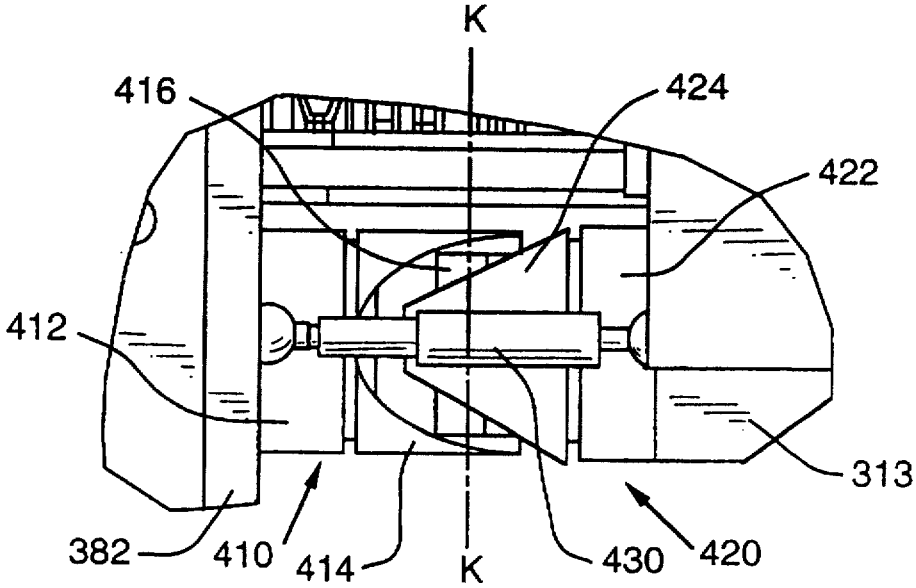
FIG. 17 is a partial side elevational view of the joint of FIG. 16.
Figure 18:
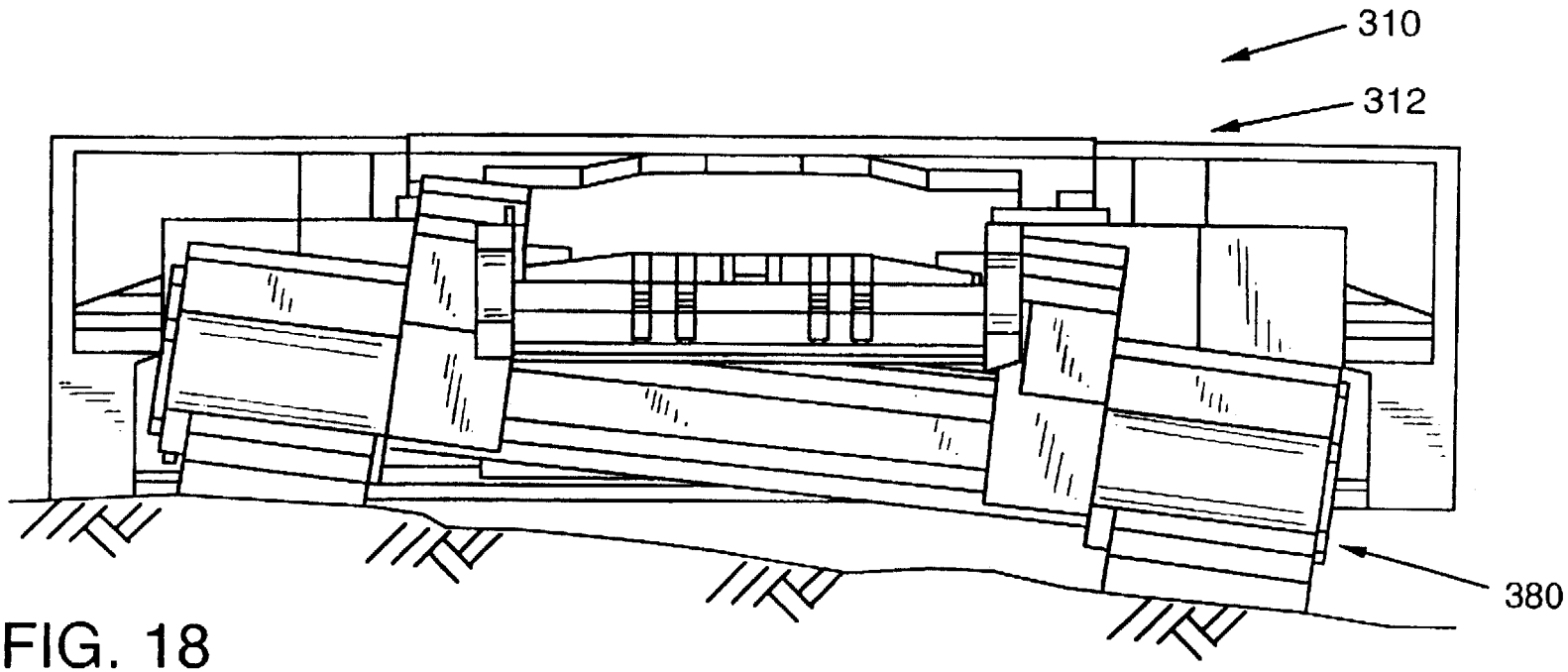
FIG. 18 is an end elevational view of the mining machine of FIGS. 13–17 with the propulsion module thereof pivoted about a longitudinal axis relative to the mining module.

As can be seen in FIGS. 16 and 17, attachment portion 414 of bearing joint 410 supports a vertically extending pin 416. Attachment portion 424 of bearing joint 420 supports a horizontally extending pin 426 that extends through a hole in vertical pin 416 such that both pins (416, 426) can pivot relative to each other. Thus, the skilled artisan will appreciate that the joint assembly 400 enables the propulsion module 380 to pivot/rotate relative to the mining module about the longitudinally extending axis I—I, a transverse horizontal axis J—J and a vertical axis K—K. As such, the propulsion model 380 can pivot relative to the mining module 312 in response to undulations in the mining floor. See FIG. 18. In a preferred embodiment, left and right hydraulically powered steering cylinders 430 are attached between the mining module 312 and the propulsion module 380 for selectively pivoting the propulsion module 380 relative to the mining module 312 about vertical axis K—K to enable the mining machine 310 to be steered around corners and bends in the entry. The skilled artisan will appreciate that the cylinders are attached to the propulsion module 380 and the mining module 312 preferably by commercially available ball/socket joint assemblies 432 to provide flexibility to the cylinders 430 during steering. Those of ordinary skill in the art will also appreciate that other universal joint arrangements could be successfully employed to attach the propulsion module 380 to the mining module 312. For example, the second ball bearing joint assembly 420 could be eliminated.

The skilled artisan will readily appreciate that this embodiment of the present invention is remote controlled by an operator located adjacent the highwall utilizing conventional remote control apparatuses and techniques and provides improved propulsion over prior mining machine designs. While the unique pivoting arrangement between the propulsion module 380 and the mining module 312 enables the unit to accommodate undulations in the entry floor, the increased length of the unit serves to facilitate its advancement into the seam in a substantially straight line.

Accordingly, the present invention provides solutions to the aforementioned problems associated with utilizing prior self-propelled mining machines in highwall mining applications. In particular, the skilled artisan will appreciate that the above-described preferred embodiments of the present invention have improved traction capabilities that enable such machines to achieve deeper penetrations than were achievable when using prior mining machines. Furthermore, the present invention is particularly well-adapted for mining downdipping seams where controlled braking and advancement of the machine is required.

The reader will, of course, appreciate that various changes in the details, materials and arrangements of parts which have been herein described and illustrated in order to explain the nature of the invention may be made by those skilled in the art within the principle and scope of the invention as expressed in the appended claims.

What is claimed is:

1. A mining machine, comprising:

an elongated frame member having a front portion, a rear portion, a top portion and two lateral sides;

mining means operably attached to said front portion of said elongated frame member for dislodging material from a seam upon contact therewith to form an entry therein having a floor, a roof and two side walls;

at least one first propulsion means attached to said elongated frame member for propelling said mining machine on a surface;

at least one second propulsion means pivotally attached to a corresponding lateral side of said elongated frame member and being selectively pivotable between a first extended position wherein said second propulsion means engages a corresponding side wall of said entry and a second retracted position wherein said second propulsion means is adjacent said corresponding lateral side of said elongated frame member such that said second propulsion means does not engage said corresponding side wall of said entry;

pivot means attached to said elongated frame member and each said second propulsion means for selectively pivoting each said second propulsion means between said first extended position and said second retracted position; and conveying means operably supported on said elongated frame member for conveying said dislodged material from said front portion of said elongated frame member to said rear portion thereof for discharge therefrom.

2. The mining machine of claim 1 wherein each said first propulsion means comprises an endless driven member operably attached to each said lateral side of said elongated frame member and wherein each said second propulsion means comprises an endless driven member.

3. The mining machine of claim 1 wherein each said pivot means comprises at least one hydraulic cylinder corresponding to each said second propulsion means.

4. The mining machine of claim 1 wherein said conveying means comprises at least one endless driven chain operably supported on said elongated frame member and extending from said front portion to said rear portion thereof, each endless driven chain having a plurality of scraper pads attached thereto for urging said material from the front portion of said elongated frame to the rear portion of said elongated frame.

5. The mining machine of claim 1 wherein each said first propulsion means comprises a first endless driven member attached to each said lateral side of said elongated frame member for propelling said mining machine on a surface and wherein each said second propulsion means comprises a second endless driven member pivotally attached to a corresponding lateral side of said elongated frame member and being selectively pivotable between a first extended position wherein said second endless driven member engages a corresponding side wall of said entry and a second retracted position wherein said second endless driven member is adjacent said corresponding lateral side of said elongated frame member such that said second endless driven member does not engage said corresponding side wall of said entry and wherein each said pivot means comprises at least one hydraulically powered cylinder attached to said elongated frame member and each said second endless driven member for selectively pivoting each said second endless driven member between said first extended position and said second retracted position and wherein said conveying means comprises at least one endless driven chain operably supported on said elongated frame member and extending from said front portion to said rear portion thereof, each endless driven chain having a plurality of scraper pads attached thereto for urging said material from the front portion of said elongated frame to the rear portion of said elongated frame.

6. A mining machine comprising:

an elongated frame member having a front portion, a rear portion, a top portion, two lateral sides and a longitudinal axis extending the length thereof;

mining means operably attached to said front portion of said elongated frame member for dislodging material from a seam upon contact therewith;

at least one first propulsion means attached to said elongated frame member for propelling said mining machine on a surface;

a propulsion module having a front portion, a rear portion and two lateral side portions and second propulsion means attached thereto for propelling said propulsion module on a surface and providing additional propulsion to said elongated frame member;

means for pivotably attaching said propulsion module to said rear portion of said elongated frame such that said propulsion module can rotate about said longitudinal axis relative to said elongated frame member and a first horizontal pivot axis that is substantially transverse to said longitudinal axis and a second vertical axis substantially perpendicular to said first horizontal axis; and conveying means operably supported on said elongated frame member and said propulsion module for conveying said dislodged material from said front portion of said elongated frame member to the rear portion of said propulsion module for discharge therefrom.

7. The mining machine of claim 6 wherein said means for pivotally attaching said propulsion module to said elongated frame member comprises:

a first ball bearing assembly attached to said propulsion module and having a first pin that extends vertically to define said vertical axis; and a second ball bearing assembly attached to said elongated frame, said second ball bearing assembly having a second horizontal pin that defines said transverse horizontal axis, said second horizontal pin being supported by said vertical axis such that said horizontal pin can pivot relative thereto.

8. The mining machine of claim 6 further comprising steering means attached to said propulsion module and said elongated frame member for selectively pivoting said propulsion module relative to said elongated frame about said vertical axis.

9. The mining machine of claim 8 wherein said steering means comprises at least one hydraulic cylinder.

10. The mining machine of claim 6 wherein each said first propulsion means comprises a first endless driven member operably attached to each said lateral side of said elongated frame member and wherein said second propulsion means comprises a second endless driven member operably attached to each said lateral side of said propulsion module.

11. The mining machine of claim 6 wherein said conveying means comprises at least one endless driven chain operably supported on said elongated frame member and said propulsion module extending from said front portion of said elongated frame member to the rear portion of said propulsion module, each endless driven chain having a plurality of scraper pads attached thereto for urging said material from the front portion of said elongated frame member to the rear portion of said propulsion module for discharge therefrom.

* * * * *